US008915036B2

(12) United States Patent
Vander Laan et al.

(10) Patent No.: US 8,915,036 B2
(45) Date of Patent: Dec. 23, 2014

(54) FORMED INTERLOCKING ROOFING PANELS

(71) Applicant: Quality Edge, Inc., Walker, MI (US)

(72) Inventors: Paul W. Vander Laan, Hamilton, MI (US); Mike Moerler, Fennville, MI (US); Todd Alexander, Rockford, MI (US)

(73) Assignee: Quality Edge, Inc., Walker, MI (US)

( * ) Notice: Subject to any disclaimer, the term of this patent is extended or adjusted under 35 U.S.C. 154(b) by 0 days.

(21) Appl. No.: 13/791,437

(22) Filed: Mar. 8, 2013

(65) Prior Publication Data

US 2014/0250815 A1 Sep. 11, 2014

(51) Int. Cl.
*E04D 3/362* (2006.01)
*E04D 1/34* (2006.01)

(52) U.S. Cl.
CPC ..... *E04D 1/34* (2013.01)
USPC ..... 52/520; 52/539; 52/545; 52/547; 52/126.1; 52/747.1

(58) Field of Classification Search
USPC ..... 52/520, 539, 545, 547, 573.1, 747.1, 52/748.1, 478, 582.1, 592.1, 126.1
See application file for complete search history.

(56) References Cited

U.S. PATENT DOCUMENTS

| | | | | |
|---|---|---|---|---|
| 361,031 | A | | 4/1887 | Thorn |
| 422,571 | A | | 3/1890 | Cooper |
| 720,893 | A | | 2/1903 | Charlebois |
| 1,110,272 | A | | 9/1914 | Probert |
| 1,121,594 | A | | 12/1914 | Probert |
| 1,204,885 | A | | 11/1916 | Koerner |
| 1,510,614 | A | | 10/1924 | Torrence |
| 2,128,495 | A | * | 8/1938 | Murphy ..... 52/520 |
| 2,173,774 | A | * | 9/1939 | Birch et al. ..... 52/522 |
| 2,682,236 | A | | 6/1954 | Holmstrom et al. |
| 3,218,772 | A | | 11/1965 | Martin |
| 3,603,057 | A | | 9/1971 | Curran |
| 3,760,545 | A | | 9/1973 | Pearse et al. |
| 3,852,933 | A | * | 12/1974 | Guzzo ..... 52/533 |
| 4,084,365 | A | | 4/1978 | Read |
| 4,295,316 | A | * | 10/1981 | Carlson ..... 52/588.1 |
| 4,356,673 | A | * | 11/1982 | Gailey ..... 52/127.1 |
| 4,382,354 | A | * | 5/1983 | Gailey et al. ..... 52/521 |
| 4,424,655 | A | * | 1/1984 | Trostle ..... 52/520 |
| 4,435,933 | A | * | 3/1984 | Krowl ..... 52/309.1 |
| 4,593,512 | A | * | 6/1986 | Funaki ..... 52/519 |

(Continued)

FOREIGN PATENT DOCUMENTS

JP 5-280159 * 10/1993

*Primary Examiner* — Robert Canfield
(74) *Attorney, Agent, or Firm* — Price Heneveld LLP

(57) ABSTRACT

An interlocking panel system for top-down or bottom-up installation on an underlying structure including a plurality of panels, with an uphill course and a downhill course where each panel is generally rectangular, having an uphill edge and opposing downhill edge. An interlocking member is disposed along the uphill edge, and a receiving member adapted to receive the interlocking member and a joining flange are disposed along the downhill edge. A first panel is positioned on an underlying structure. In top-down installation, a clip is disposed along the downhill edge of the first panel and affixed to the underlying structure, and a second panel is engaged with the receiving member of the first panel. In bottom-up installation, the first panel is affixed to the underlying structure, and a second panel is engaged with the interlocking member of the first panel, and then affixed to the underlying structure.

15 Claims, 5 Drawing Sheets

(56) References Cited

U.S. PATENT DOCUMENTS

| | | | | | |
|---|---|---|---|---|---|
| 4,669,238 | A | * | 6/1987 | Kellis et al. | 52/105 |
| 4,878,331 | A | * | 11/1989 | Taylor | 52/519 |
| 4,947,609 | A | * | 8/1990 | Champagne | 52/545 |
| 5,012,623 | A | | 5/1991 | Taylor | |
| 5,074,093 | A | | 12/1991 | Meadows | |
| 5,355,649 | A | * | 10/1994 | Berridge | 52/520 |
| 5,392,579 | A | * | 2/1995 | Champagne | 52/520 |
| 5,622,020 | A | * | 4/1997 | Wood | 52/546 |
| 5,675,955 | A | * | 10/1997 | Champagne | 52/521 |
| 5,685,117 | A | * | 11/1997 | Nicholson | 52/520 |
| 5,878,543 | A | * | 3/1999 | Mowery | 52/519 |
| 6,226,950 | B1 | * | 5/2001 | Davis | 52/592.1 |
| 6,298,626 | B2 | * | 10/2001 | Rudden | 52/520 |
| 6,367,220 | B1 | * | 4/2002 | Krause et al. | 52/512 |
| 6,883,290 | B2 | * | 4/2005 | Dinwoodie | 52/748.1 |
| 7,562,505 | B2 | * | 7/2009 | Tohanczyn, Jr. | 52/539 |
| 7,571,571 | B1 | * | 8/2009 | Mershon | 52/36.5 |
| 7,823,333 | B2 | * | 11/2010 | Kim | 52/36.5 |
| 7,980,037 | B2 | * | 7/2011 | Trabue et al. | 52/522 |
| 8,387,325 | B2 | * | 3/2013 | Mullet et al. | 52/526 |
| 2005/0072091 | A1 | * | 4/2005 | Morris | 52/518 |
| 2006/0075712 | A1 | * | 4/2006 | Gilbert et al. | 52/520 |
| 2010/0132295 | A1 | * | 6/2010 | Bootier et al. | 52/520 |
| 2010/0180542 | A1 | * | 7/2010 | Stoecker | 52/745.21 |
| 2010/0186334 | A1 | | 7/2010 | Seem | |

* cited by examiner

FORMED INTERLOCKING ROOFING PANELS

CROSS-REFERENCE TO RELATED APPLICATION

This application is related to U.S. patent application Ser. No. 13/791,327, filed on Mar. 8, 2013, entitled "FORMED INTERLOCKING ROOFING PANELS," the entire disclosure of which is hereby incorporated herein by reference.

BACKGROUND OF THE INVENTION

The invention is in the field of interlocking panels for installation on an underlying structure.

SUMMARY OF THE INVENTION

In one aspect, the invention includes an interlocking panel system for installation on an underlying structure, including a plurality of panels defining an uphill course of panels and a downhill course of panels, wherein each of the panels includes a generally rectangular panel body with an uphill edge and an opposing downhill edge. An interlocking member is disposed along the uphill edge of each panel body and a receiving member is disposed along the downhill edge of each panel body. The receiving member is adapted to receive the interlocking member and the receiving member has a span which permits positional adjustment of the downhill course of panels with respect to the uphill course of panels. The system also includes a clip, which has a bracket and a joining flange.

In another aspect, the invention includes an interlocking panel system for installation on an underlying structure having a plurality of panels defining an uphill course of panels and a downhill course of panels, wherein each of the panels includes a generally rectangular panel body with an uphill edge and an opposing downhill edge. An interlocking member is disposed along the uphill edge of each panel body, and a receiving member is disposed along the downhill edge of each panel body. The receiving member is adapted to receive the interlocking member and has a span which permits positional adjustment of the downhill course of panels with respect to the uphill course of panels. The panels are adapted to be installed in a ridge-to-eave or eave-to-ridge direction.

In a further aspect, the invention includes a method of installing an interlocking panel system on an underlying structure. The method includes the step of positioning a first panel on an underlying structure, wherein the first panel has a first panel body with a first downhill edge, and a receiving member disposed along the first downhill edge. At least one clip, having a bracket and a joining flange, is engaged with the downhill edge of the first panel and affixed to the underlying structure. A second panel, having a second panel body with a second uphill edge and an interlocking member disposed along the second uphill edge, is provided. The second interlocking member is inserted into the first receiving member. The second panel is then directly or indirectly affixed to the underlying structure.

These and other features, advantages, and objects of the present invention will be further understood and appreciated by those skilled in the art by reference to the following specification, claims, and appended drawings.

DETAILED DESCRIPTION OF EMBODIMENTS

Figure 1:
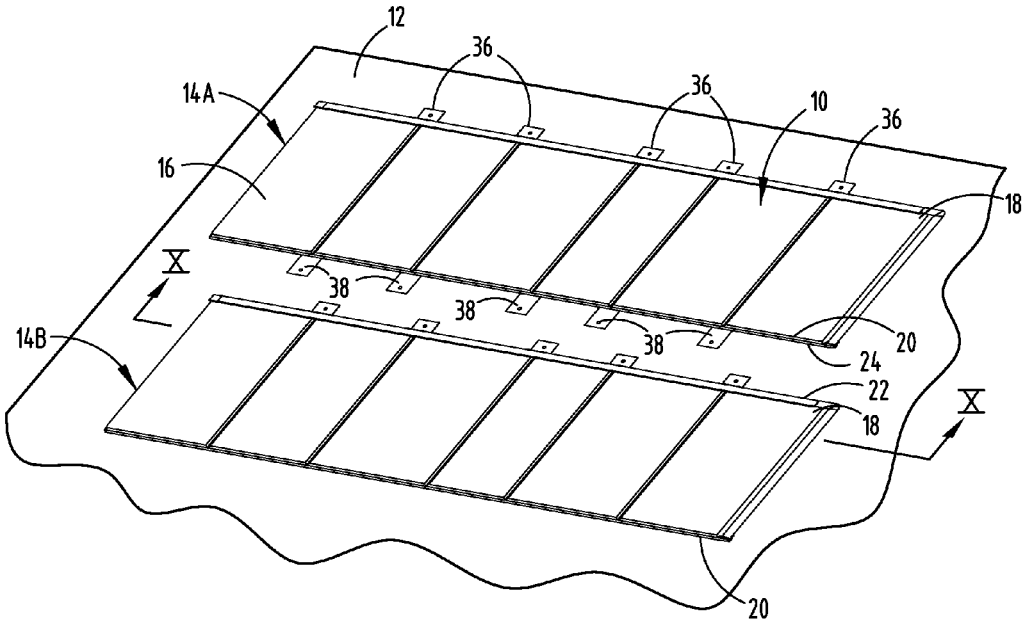
FIG. 1 is a top perspective view of an interlocking panel system according to one embodiment of the present invention.
Figure 2:
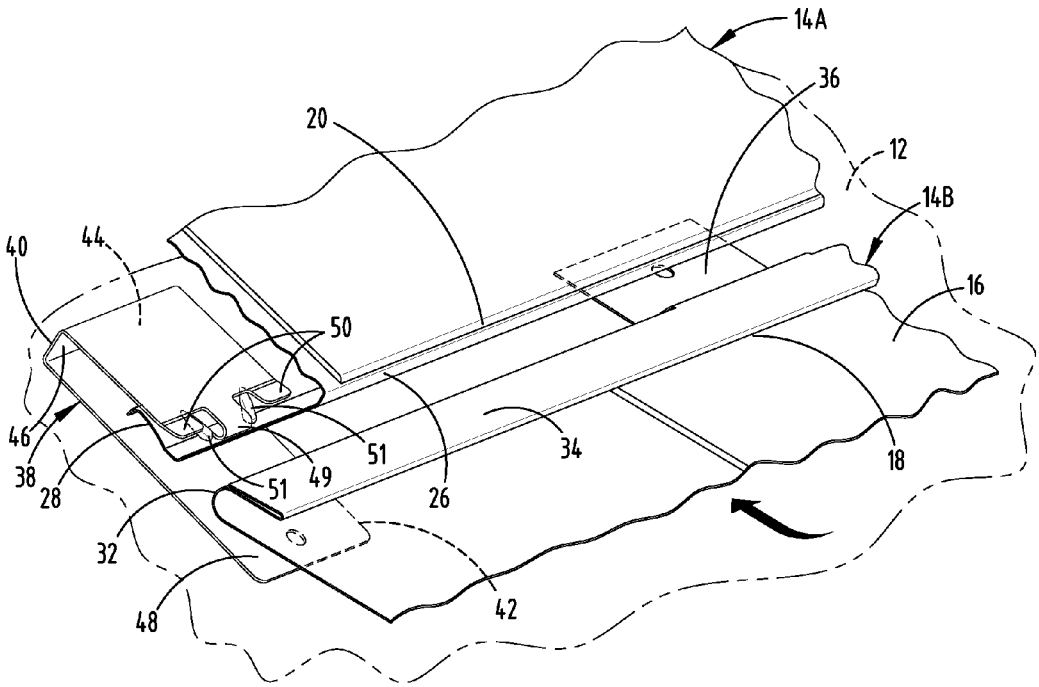
FIG. 2 is an enlarged top perspective view of the interlocking portion of the interlocking panel system prior to engagement of the downhill panel.

For purposes of description herein the terms "upper," "lower," "right," "left," "rear," "front," "vertical," "horizontal" and derivatives thereof shall relate to the invention as oriented in FIG. 1. However, it is to be understood that the invention may assume various alternative orientations and step sequences, except where expressly specified to the contrary. As used herein, "uphill" or the "uphill direction" refers to being located higher in the vertical direction (upon installation, unless described otherwise). Correspondingly, as used herein, "downhill" or the "downhill direction" refers to being located lower in the vertical direction (upon installation, unless described otherwise). It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The embodiment of an interlocking panel system 10 for installation on an underlying structure 12 shown in FIGS. 1-9 includes a plurality of panels 14, suitable for installation on the underlying structure 12 in a top-down manner or in a bottom-up manner, as selected by the installer. Once installed, the panels 14 form a watertight barrier over the structure 12, with fasteners 15 hidden from view.

Each of the panels 14 shown in FIGS. 1-9 includes a generally rectangular panel body 16 with an uphill edge 18 and an opposing downhill edge 20. An interlocking member 22 is disposed on the uphill edge 18 of each panel body 16. A receiving member 24 is disposed on the downhill edge 20 of each panel body 16. The receiving member 24 of each panel 14A is adapted to receive the interlocking member 22 of an adjacent downhill panel 14B.

As shown in FIGS. 2-5, the receiving member 24 includes a downwardly depending arm 26 and a deformable arm 28. The downwardly depending arm 26 extends generally toward the underlying structure 12 from the downhill edge 20 of the panel body 16. The deformable arm 28 extends in a generally uphill direction from the downwardly depending arm 26. The receiving member 24 is adapted to receive the interlocking member 22 of a downhill panel 14B, and has a span 30 which permits positional adjustment of the downhill course of panels 14B in the uphill-downhill direction with respect to the uphill course of panels 14A.

Figure 3:
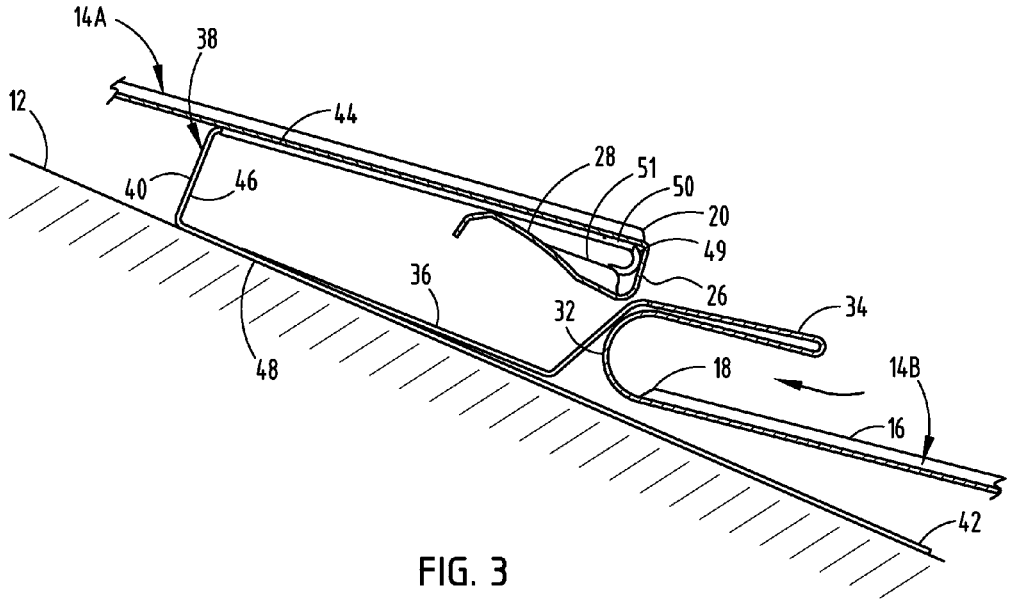
FIG. 3 is an enlarged side elevational view of the interlocking portion of the interlocking panel system prior to engagement of the downhill panel.
Figure 4:
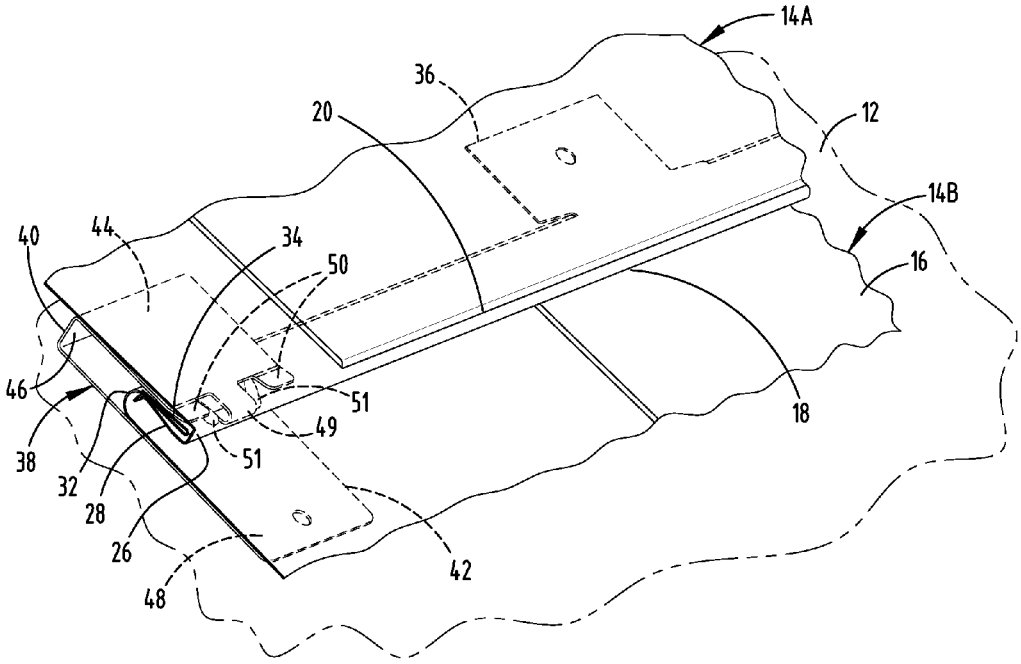
FIG. 4 is an enlarged top perspective view of the interlocking portion of the interlocking panel system following engagement of the downhill panel.
Figure 5:
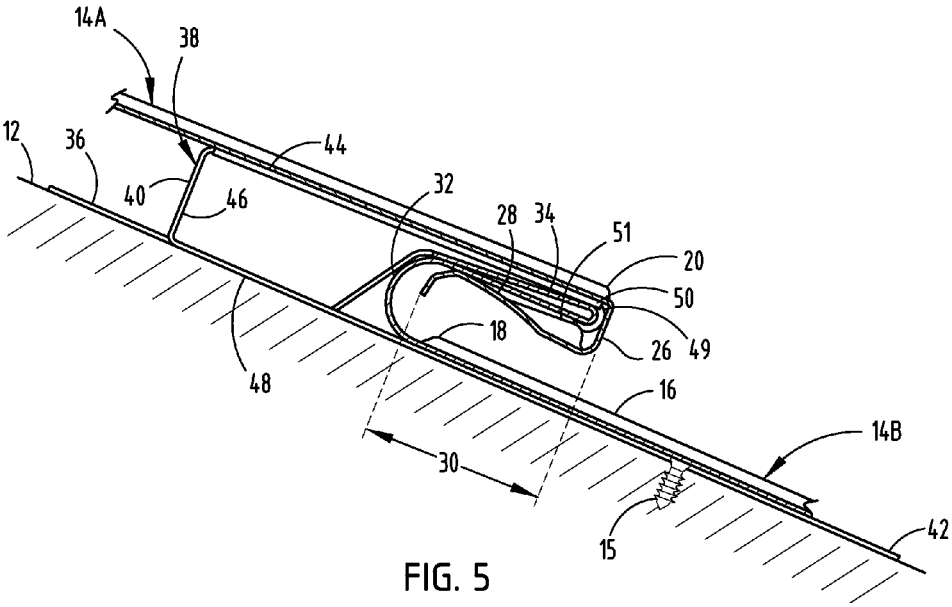
FIG. 5 is an enlarged side elevational view of the interlocking portion of the interlocking panel system following engagement of the downhill panel.

The interlocking member 22, as best shown in the embodiment depicted in FIG. 3, includes an upwardly directed arm 32 extending away from the underlying structure 12 and a locking arm 34 which extends in a generally downhill direction from the upwardly directed arm 32. The upwardly directed arm 32 extends generally from the uphill edge 18 of the panel body 16.

In use for top-down installation, as best shown in the embodiment depicted in FIGS. 2-5, the interlocking member 22 is inserted between the receiving member 24 and the underlying structure 12. The deformable arm 28 of the receiving member 24 deforms to allow insertion of the interlocking member 22. Once the interlocking member 22 is inserted past the receiving member 24 the downhill panel 14B is moved by the installer in a downward direction with respect to the uphill panel 14A, such that the locking arm 34 of the interlocking member 22 is positioned between the deformable arm 28 of the receiving member 24 and the uphill panel 14A. The downhill panel 14B can be adjusted in the uphill-downhill direction until the end of the locking arm 34 contacts the downwardly depending arm 26 of the receiving member 24.

Joining tabs 36 are disposed along the uphill edge 18 of the panel body 16, as shown in FIG. 1. If installation is preferred to occur in the bottom-up direction, the joining tabs 36 are used to affix the panel 14B to the underlying structure 12.

A plurality of clips 38 are disposed along the downhill edge 20 of the panel body 16. Each of the plurality of clips 38 has a bracket 40 and a joining flange 42, and is adapted to be attached to the downhill edge 20 of the panel body 16. As shown in FIGS. 2-5, the bracket 40 is generally U-shaped, and includes a panel wall 44, an end wall 46, and a structure wall 48. The panel wall 44 is generally adjacent and parallel to the panel 14 upon installation. The structure wall 48 is generally adjacent and parallel to the underlying structure 12 upon installation. The end wall 46 extends generally perpendicular to and connects the panel wall 44 and the structure wall 48. The joining flange 42 extends from the structure wall 48 in the downhill direction.

In use, the plurality of clips 38 are positioned such that the panel wall 44 fits within the receiving member 24, the end wall 46 is uphill from the receiving member 24, and the joining flange 42 extends downhill beyond the downhill edge 20 of the panel body 16. When the plurality of clips 38 are used with the receiving member 24, the end wall 46 of the plurality of clips 38 defines the greatest overlap that can be achieved between an uphill panel 14A and a downhill panel 14B.

Figure 6:
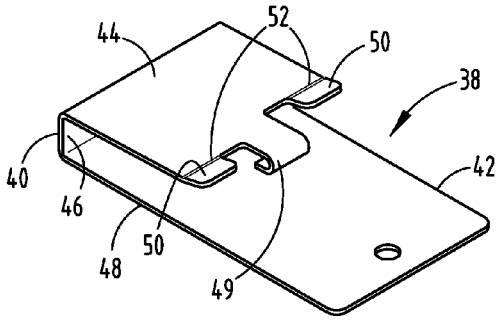
FIG. 6 is a top perspective view of a roof-to-eave installation clip.
Figure 7:
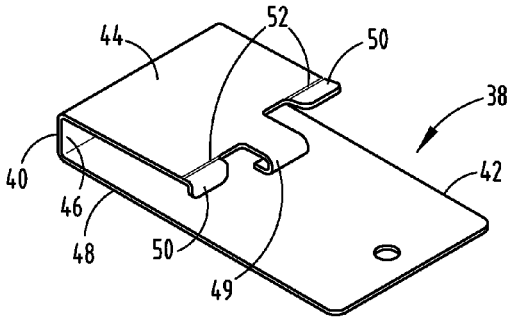
FIG. 7 is a top perspective view of the roof-to-eave installation clip adjusted for a first course correction amount.
Figure 8:
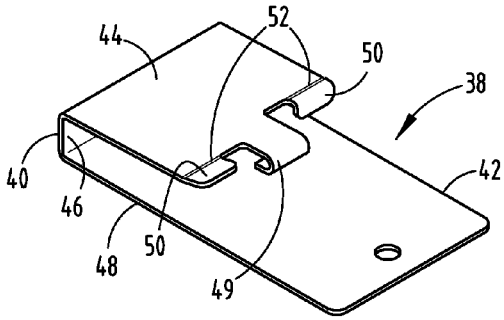
FIG. 8 is a top perspective view of the roof-to-eave installation clip adjusted for a second course correction amount.

The structure wall 48, as best shown in FIGS. 6-8, includes a curved nose 49 on its downhill end. As shown in FIGS. 2-5, the curved nose 49 of the clip 38 mates with the locking arm 34 of the interlocking member 22, particularly with the downhill end of the locking arm 34. Additionally, indentation features 51 may be provided on the locking arm 34. Indentation features 51 include v-shaped indentations in the locking arm 34, which guide the downhill panel 14B into the desired position with respect to the clip 38 and the uphill panel 14A. The indentation features 51 mechanically engage with the structure wall 48, and particularly the curved nose 49 thereof when a clip 38 is installed in the desired position along the length of the panels 14.

The engagement between the curved nose 49 and locking arm 34 transfers forces exerted on the panel 14 in a direction parallel to the underlying structure 12 (e.g., in a downhill direction or toward the right or left) to the clip 38. Such forces are generated, for example, when a person walks on the installed interlocking panel system 10, when snow or ice accumulate on the installed panel system 10, or when extreme wind conditions are present.

Each of the plurality of clips 38 is also optionally provided with one or more course correction tabs 50, as shown in the embodiment depicted in FIGS. 6-8. Course correction tabs 50 facilitate the adjustment of the position of the downhill course of panels 14B so that anomalies in the underlying structure 12 can be accommodated and courses of panels 14 remain straight. The course correction tabs 50 are provided at the downhill edge of the panel wall 44. The desired course correction tab 50 is bent downward by the installer, such that it shortens the distance the interlocking member 22 can be inserted into the receiving member 24.

In the embodiment shown in FIGS. 6-8, two course correction tabs 50 are provided for each plurality of clips 38. The course correction tabs 50 are scored by the manufacturer at different distances from the downhill end of the panel wall 44. The appropriate course correction tabs 50 shown in FIGS. 6-8 are selected by the installer on site, and the desired course correction tab 50 is bent along a score line 52. Alternatively, the course correction tabs 50 could include several score lines 52 for each course correction tab 50, with the desired score line 52 to be selected by the installer, or could include markings and measurements to be scored at the desired distance from the end of the panel wall 44 on site during installation. Course correction tabs 50 could also be bent, rather than or in addition to being scored, so that the course correction tab 50 is to be removed by the installer if not used. Course correction tabs 50 could also be solid, and scored and/or bent by the installer at the time of installation so that the installer is not limited to specific intervals for the course correction length.

When the course correction tabs 50 are used, the downhill panel 14B can be adjusted in the downhill direction until the end of the locking arm 34 contacts the course correction tab 50. Therefore, the course correction tabs 50 permit the installer to adjust the position of the downhill course of panels 14B by folding the course correction tab 50 to the desired distance of the course correction.

As shown in the embodiment depicted in FIGS. 2-5 and 9, the interlocking member 22 and the receiving member 24 engage in such a way that they are held parallel to the underlying structure 12 and generally parallel with the panels 14.

The interlocking panel system 10 is capable of installation in a top-down manner, or in a bottom-up manner. To install the panels 14 in a traditional bottom-up manner, the first panel 14A is positioned on the underlying structure 12 in the desired position, and then the joining tabs 36 are affixed to the underlying structure 12 using the fasteners 15. The fasteners 15 may be used for attachment of a roofing panel or a siding panel to the underlying structure 12, and are appropriate for affixing the joining flange 42 to the underlying structure 12, including, without limitation, nails, screws, adhesives, or other fasteners.

Figure 10:
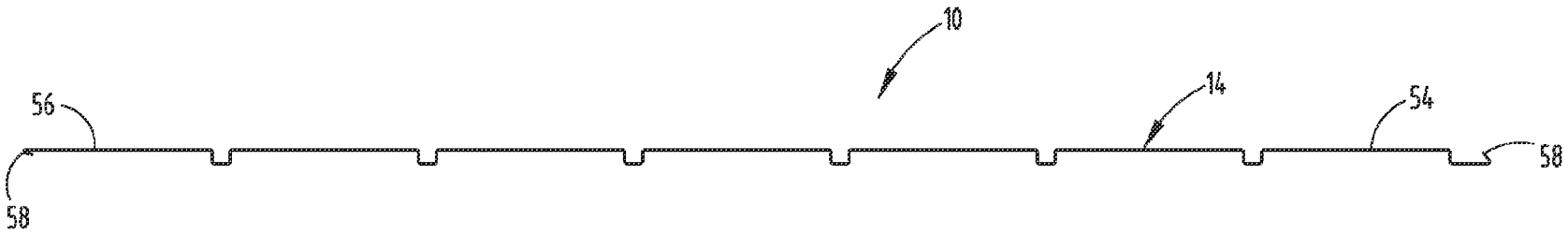
FIG. 10 is a side elevation view of the section taken along line X-X of FIG. 1.

An adjacent panel 14B (to the right or left side of the first panel 14B) is then optionally affixed to the underlying structure 12, overlapping right or left edges 54, 56, as applicable, of the previously installed panel 14B to form a downhill course of panels 14B. As shown in the embodiment depicted in FIG. 10, each generally rectangular panel body 16 includes the right edge 54 and the left edge 56, in addition to the uphill and downhill edges 18, 20. A watertight course of panels 14 includes panels 14 affixed to the underlying structure 12 from left to right (or right to left) to form a horizontal line with the left edge 56 of each panel 14 overlapping the right edge 54 of the adjacent panel 14 (or vice versa). As shown in the embodiment of FIGS. 1 and 10, interlocking flange features 58 are provided on the right edge 54 and the left edge 56 to permit adjacent (side-by-side) panels 14 to interlock. Interlocking of adjacent flange features 56 from left to right (or right to left) across the underlying structure 12 allows the panels 14 to be installed in the watertight horizontal course.

A second panel 14A is positioned uphill from the first panel 14B. The receiving member 24 of the uphill panel 14A is engaged with the interlocking member 22 of the downhill panel 14B and the uphill panel 14A is then pulled taut against the interlocking member 22 of the downhill panel 14B and the joining tabs 36 at the uphill edge 18 of the second panel 14A are affixed to the underlying structure 12. An adjacent panel 14A (to the right or left side of the second panel 14A) is then optionally affixed to the underlying structure 12, overlapping the right or left edges 54, 56, as applicable, of the previously installed panel 14B to form an uphill course of panels 14A. The second panel 14A (the uphill panel 14A) can then function as the downhill panel 14B, allowing the installation of another course of panels on the uphill edge 18 of the second panel 14A.

To install the interlocking panel system 10 in the top-down manner, a first panel 14A is positioned on the underlying structure 12. One or more of the plurality of clips 38 are inserted between the downhill edge 20 of the panel 14A and the underlying structure 12. The bracket 40 of each of the plurality of clips 38 is engaged with the receiving member 24 between the deformable arm 28 and the panel body 16 along the downhill edge 20 of the panel 14A.

The joining flange 42 portion of the plurality of clips 38 is affixed to the underlying structure 12 using the fasteners 15. Adjacent panels 14A (to the right or left side of the first panel 14A) are then optionally affixed to the underlying structure 12, overlapping the right and left edges 54, 56 of the previously installed panels 14A to form an uphill course of panels 14A.

A second panel 14B is then positioned along the downhill edge 20 of the first panel 14A. The joining tabs 36 along the uphill edge 18 of the second panel 14B are offset from the joining flanges 42 of the plurality of clips 38. The second panel 14B is inserted underneath the downhill edge 20 of the uphill panel 14A such that the deformable arm 28 of the receiving member 24 is pushed toward the panel body 16 to allow the interlocking member 22 to pass between the receiving member 24 and the underlying structure 12. When the downhill panel 14B is inserted beyond the deformable arm 28, the deformable arm 28 returns to its original position. The panel 14B is then adjusted in the downhill direction such that the interlocking member 22 is engaged in the receiving member 24.

To achieve the most stable interlocking panel system 10 installation, the downhill panel 14B is pulled in a downhill direction until taught against the uphill panel 14A. When taught, the locking arm 34 will be in contact with the downwardly depending arm 26 of the receiving member 24, or the course correction tab 50, as described below. The interlocking member 22 and the receiving member 24 are dimensionally optimized to allow movement of the downhill panel 14B in the uphill-downhill direction to permit the interlocking member 22 of the downhill panel 14B to engage with the receiving member 24 of the uphill panel 14A.

Figure 9:
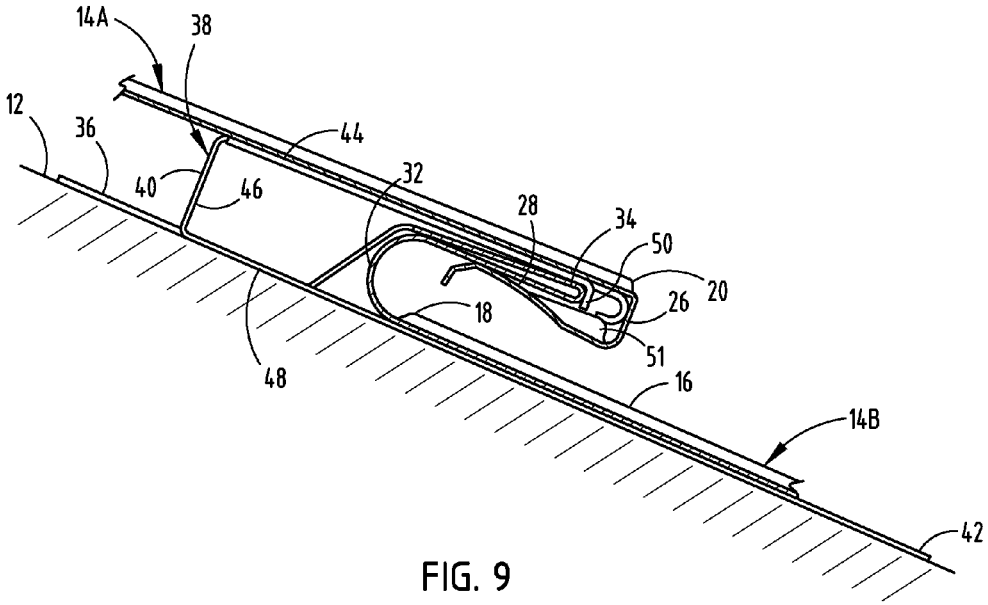
FIG. 9 is an enlarged side perspective view of an interlocking portion of the interlocking panel system showing defined course correction.

The course correction tabs 50 of the plurality of clips 38 can then be folded downward, as shown in the embodiment depicted in FIG. 9, to provide course correction of the downhill panel 14B. When the course correction tab 50 is folded downward, the distance is limited that the downhill panel 14B can be moved in the downhill direction, as the interlocking member 22 comes into contact with the course correction tab 50 and can be pulled taught against the course correction tab 50.

To ensure that multiple courses of the interlocking panel system 10 remain in straight lines and that the interlocking panel system 10 lines up with, for example, an eave line of a roof, upon completion of installation, the installer can mark lines on the underlying structure 12 prior to installing panels 14 to indicate correct panel placement. Courses of panels 14 are checked against the lines periodically. When variations in the underlying structure 12 or tolerance stack-up cause the position of the panel 14 to vary from the lines, the installer can use the course correction tabs 50 to re-align the interlocking panel system 10 with the desired position.

The interlocking panel system 10 can optionally be sized to incorporate intentional over-alignment, to bias any non-alignment of the panel 14 with the lines toward the downhill direction. For example, installers may be instructed to mark lines every 12 inches for a course of panels 14, while the actual assembled panel 14 is constructed to have a length slightly greater than 12 inches, such as 12.03125 inches. Therefore, after installation of four courses, the panels 14 should align 0.125 inches downhill of the relevant line. In the interlocking panel system 10 that is intentionally biased in this way, the course correction tabs 50 may be scored to accommodate the intentional over-alignment of the panels 14, with lengths that would equal the intentional over-alignment. In the example described herein, the course correction tabs 50 are scored at about 0.125 inch and at about 0.25 inch, to accommodate the intentional over-alignment of panels 14, and the course of panels 14 is corrected about every four rows. However, various other values for the length of assembled panel 14, number of courses before re-aligning, and length of course correction tabs 50 can be selected.

The interlocking member 22, the receiving member 24, and the course correction tabs 50 described herein allow the engaging surfaces of the interlocking member 22 and the receiving member 24 to remain parallel to the underlying structure 12, which prevents wind rattling of the installed interlocking panel system 10. Similarly, the layout of the interlocking member 22 and the receiving member 24 allow the engaging surfaces of the interlocking member 22 and the receiving member 24 to remain parallel to the underlying structure 12.

The interlocking panel system 10, as described above, is able to be installed on the underlying structure 12 in a top-down manner, with the hidden fasteners 15 to improve the appearance and improve the water barrier created by the interlocking panel system 10. The interlocking panel system 10 also incorporates the span 30, which permits positional adjustment of the downhill panel 14B with respect to the uphill panel 14A, ensuring that the appearance of the interlocking panel system 10 remains uniform and forms a straight line at the desired bottom end-point, and that variations in the underlying structure 12 and any tolerance stack-ups are accommodated by the interlocking panel system 10.

Each panel 14 may include more than one depiction of a "shingle" thereon, to maintain the appearance of traditional shingled roofing or siding materials, but to ease installation. The panels 14 may also include alternate patterns, stampings, or texturing to appear similar to existing materials, or to have a unique appearance not possible with existing roofing or siding materials. The panels 14 may be manufactured from any material (or a combination of materials) suitable for use as a roofing or siding material, which can be formed to have the described interlocking and receiving members, including, without limitation, metal suitable for use as a roofing or siding material.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, unless doing so would impede the use of the elements, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An interlocking panel system for installation on an underlying structure, comprising:

a plurality of panels defining an uphill course of panels and a downhill course of panels, wherein each of the panels includes a generally rectangular panel body with an uphill edge and an opposing downhill edge;

an interlocking member disposed along the uphill edge of each panel body and a receiving member disposed along the downhill edge of each panel body, wherein each of the receiving members is adapted to receive the interlocking member of at least one of the panels in the downhill course of panels, and wherein each of the receiving members has a span which permits positional adjustment with respect to the downhill course of panels; and a clip having a bracket and a joining flange, wherein the bracket of the clip is engageable with the downhill edge of each of the panel bodies, to be positionable between the panel body and the underlying structure, and wherein the joining flange extends below the downhill edge of the panel body when the clip is engaged with the downhill edge of the panel body.

2. The interlocking panel system of claim 1, wherein the clip includes at least one course correction tab.

3. The interlocking panel system of claim 2, wherein the course correction tab is scored at a length between about 0.25 inch and about 0.125 inch.

4. The interlocking panel system of claim 3, wherein the clip further comprises:

at least two course correction tabs, and wherein the at least two course correction tabs are scored, with each of the at least two course correction tabs having a different length than the other of the at least two course correction tabs.

5. The interlocking panel system of claim 1, wherein the bracket further comprises:

a rear wall, wherein the rear wall defines a position of maximum overlap between the interlocking member and the receiving member.

6. An interlocking panel system for installation on an underlying structure, comprising:

a plurality of panels defining an uphill course of panels and a downhill course of panels, wherein each of the panels includes a generally rectangular panel body with an uphill edge and an opposing downhill edge;

an interlocking member disposed along the uphill edge of each panel body and a receiving member disposed along the downhill edge of each panel body, wherein the receiving member of each of the panels in the uphill course of panels is adapted to receive the interlocking member of at least one of the panels in the downhill course of panels;

wherein each of the receiving members allows positional adjustment of the at least one interlocking member received therein in an uphill-downhill direction during installation;

wherein the interlocking panel system is adapted to permit installation in a ridge-to-eave direction and in an eave-to-ridge direction; and wherein each receiving member includes a downwardly depending arm and a deformable arm, which extends in a generally uphill direction from the downwardly depending arm, and wherein the interlocking member includes an upwardly-directed arm and a locking arm, which extends in a generally downhill direction from upwardly-directed arm.

7. The interlocking panel system of claim 6, further comprising:

a clip having a bracket and a joining flange, the clip being disposed along the length of at least one of the receiving members.

8. The interlocking panel system of claim 7, wherein the clip and at least one of the receiving members together define a span, which permits positional adjustment of the downhill course of panels with respect to the uphill course of panels.

9. The interlocking panel system of claim 7, wherein the clip includes course correction tabs.

10. The interlocking panel system of claim 6, further comprising:

a clip having a bracket and a joining flange, wherein the clip is adapted for attaching the downhill edge of at least one of the panels to the underlying structure for the ridge-to-eave direction installation.

11. The interlocking panel system of claim 6, wherein the deformable arm and the lockable arm are generally parallel with each other along an interface therebetween, and wherein the interface is generally parallel with the underlying structure upon installation.

12. The interlocking panel system of claim 10, wherein the clip further comprises:

course correction tabs, wherein the clip and the downwardly depending arm together define the span within which the downhill course of panels can travel.

13. A method of installing an interlocking panel system on an underlying structure, comprising the steps of:

positioning a first panel on an underlying structure, wherein the first panel includes a first panel body with a first downhill edge, and a receiving member disposed along the first downhill edge;

engaging at least one clip having a bracket and a joining flange with the downhill edge of the first panel and affixing the joining flange to the underlying structure;

providing a second panel, wherein the second panel includes a second panel body with a second uphill edge and an interlocking member disposed along the second uphill edge and a second downhill edge;

inserting the interlocking member into the receiving member;

determining the desired amount of course correction; adjusting the position of the second panel in the uphill-downhill direction to make course corrections;

bending a course correction tab on the at least one clip to orient the position of the second panel with respect to the first panel; and directly or indirectly affixing the second panel to the underlying structure.

14. The method of claim 13, further comprising the steps of:

marking the underlying structure with at least one guide line;

comparing the at least one guide line to the second downhill edge to determine whether to adjust the second panel in an uphill-downhill direction.

15. The method of claim 14, wherein the at least a first guide line and a second guide line having a first distance therebetween are marked on the underlying structure, and wherein there is a second distance between the second uphill edge and second downhill edge, and wherein the second distance is less than the first distance.

* * * * *

UNITED STATES PATENT AND TRADEMARK OFFICE

CERTIFICATE OF CORRECTION

PATENT NO. : 8,915,036 B2
APPLICATION NO. : 13/791437
DATED : December 23, 2014
INVENTOR(S) : Paul W. Vander Laan et al.

It is certified that error appears in the above-identified patent and that said Letters Patent is hereby corrected as shown below:

In the Claims

Column 8
Claim 6, line 61, insert --the-- after --from--.

Signed and Sealed this
Fourth Day of August, 2015

Michelle K. Lee

Michelle K. Lee
*Director of the United States Patent and Trademark Office*